US012789059B2

(12) United States Patent
Derman

(10) Patent No.: US 12,789,059 B2
(45) Date of Patent: Nov. 10, 2026

(54) STRIKING ELEMENT FOR A SPORTS PADDLE

(71) Applicant: Howard Derman, Irvine, CA (US)

(72) Inventor: Howard Derman, Irvine, CA (US)

( * ) Notice: Subject to any disclaimer, the term of this patent is extended or adjusted under 35 U.S.C. 154(b) by 241 days.

(21) Appl. No.: 18/762,330

(22) Filed: Jul. 2, 2024

(65) Prior Publication Data

US 2026/0007939 A1 Jan. 8, 2026

(51) Int. Cl.
*A63B 59/45* (2015.01)
*A63B 102/08* (2015.01)

(52) U.S. Cl.
CPC ..... *A63B 59/45* (2015.10); *A63B 2102/08* (2015.10)

(58) Field of Classification Search
CPC ..... A63B 59/42; A63B 59/45; A63B 2102/08; A63B 60/004
See application file for complete search history.

(56) References Cited

U.S. PATENT DOCUMENTS 6,503,856 B1 1/2003 Broadway
D994,059 S 8/2023 Jin
11,925,843 B1 * 3/2024 Bicanic ..... A63B 59/40
2012/0029450 A1 * 2/2012 Grum-Schwensen ..... A61F 5/443 604/344
2016/0107053 A1 4/2016 Pree
2021/0121763 A1 4/2021 Lutz
2021/0252356 A1 8/2021 Krebs
2022/0266106 A1 8/2022 Nygren
2023/0356048 A1 11/2023 Junkins
2025/0269252 A1 * 8/2025 Rinicella, Sr. ..... A63B 59/42

FOREIGN PATENT DOCUMENTS

EP 4062982 9/2022

* cited by examiner

*Primary Examiner* — Laura A Gudorf

(57) ABSTRACT

A ball striking apparatus for application to a sports paddle includes a sheet with a front surface and a back surface which is shaped and configured to cover a striking surface of the sports paddle. A connector is attached to the back surface of the sheet and configured to secure the sheet to the striking surface of the sports paddle. The sheet may be used to improve characteristics of the sports paddle, such as strengthening the sports paddle and providing a frictionally enhanced surface with which to urge a projectile such as a ball to spin when struck obliquely. The sheet may be replaced when it becomes worn and loses its advantageous ball-striking characteristics. The sheet may be applied to sports paddles designed for use in pickleball games and similar sports.

11 Claims, 6 Drawing Sheets

STRIKING ELEMENT FOR A SPORTS PADDLE

CROSS-REFERENCE TO RELATED APPLICATIONS

Claims benefit of provisional application 63/731,109 filed on Apr. 1, 2024.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sports paddles and more particularly pertains to a new striking element for application to a sports paddle.

(2) Description of Related Art Including Information Disclosed Under 37 CFR 1.97 and 1.98

The prior art relates to sports paddles such as the kind used in pickleball and similar sports. Various compositions and shapes have been disclosed for sports paddles. Carbon fiber, for example, has been used as a material which is desirable for its stiffness and strength-to-weight ratio as compared to other materials. However, the prior art fails to describe a sheet which may be adhered or otherwise connected to a striking surface of a paddle to provide a replaceable element which is desirable for striking a ball or other projectile. Such an arrangement may be desirable by making it possible to improve a lesser quality paddle and to allow for replacement of a component of a paddle rather than the entire paddle when wear or damage occurs.

BRIEF SUMMARY OF THE INVENTION

An embodiment of the disclosure meets the needs presented above by generally comprising a sheet with a front surface and a back surface which is shaped and configured to cover a striking surface of a paddle. A connector is attached to the back surface of the sheet and configured to secure the sheet to the striking surface of the paddle. The sheet may be used to improve characteristics of the paddle, such as strengthening the paddle and providing a frictionally enhanced surface with which to urge a projectile such as a ball to spin when struck obliquely. The sheet may be replaced when it becomes worn and loses its advantageous ball-striking characteristics. The sheet may be applied to paddles designed for use in pickleball games and similar sports.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
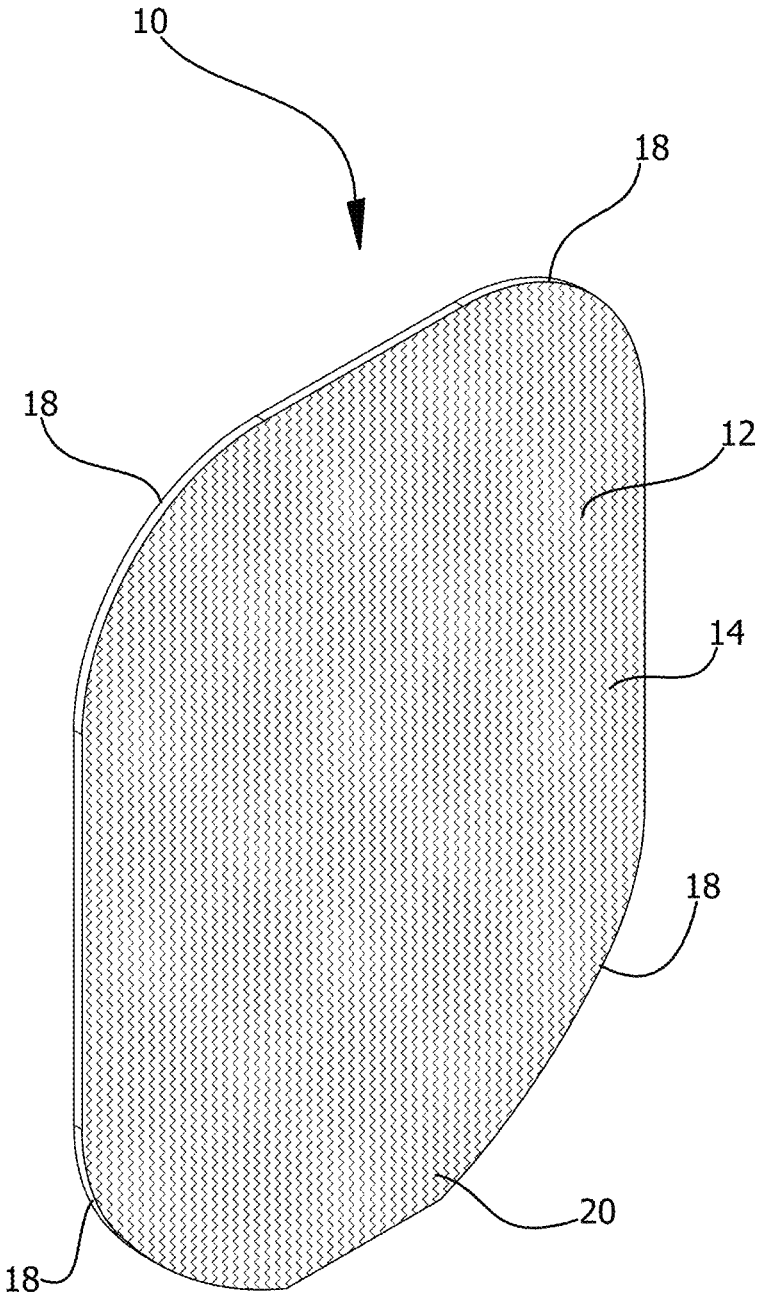
FIG. 1 is a front perspective view of a ball striking apparatus according to an embodiment of the disclosure.
Figure 2:
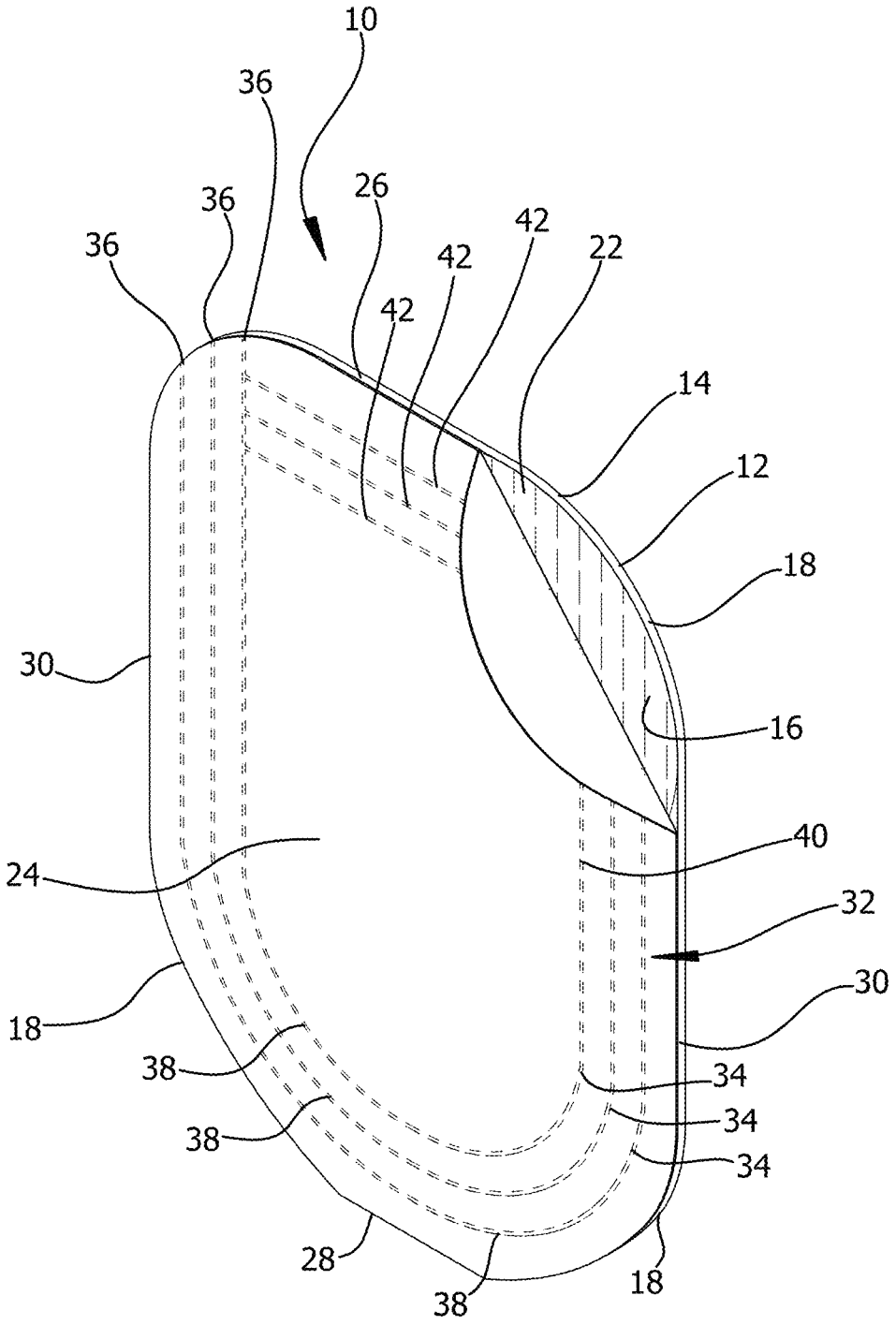
FIG. 2 is a rear perspective view of an embodiment of the disclosure.

With reference now to the drawings, and in particular to FIGS. 1 through 6 thereof, a new GENERIC embodying the principles and concepts of an embodiment of the disclosure and generally designated by the reference numeral 10 will be described.

As best illustrated in FIGS. 1 through 6, the ball striking apparatus 10 generally comprises a sheet 12 that has a front surface 14 and a back surface 16. The sheet 12 may be attached to a paddle such that the sheet 12 may be used to hit projectiles such as balls rather than surfaces of the paddle. The sheet 12 is generally rectangular with rounded corners 18, and a lower portion 20 of the sheet 12 is elongated such that the rounded corners 18 in the lower portion 20 do not have constant radii. However, the outline of the sheet 12 may vary in other embodiments. In some embodiments, the sheet 12 is complementary in shape to the paddle to which the sheet 12 is meant to attach.

The front surface 14 is frictionally enhanced to grip an exterior surface of the projectile when striking the projectile in order to induce a spinning motion in the projectile. The sheet 12 comprises fibers which are woven together and which may form a surface texture on the front surface 14 sufficient to frictionally enhance the front surface 14 as described. The surface texture also may be formed by other suitable means such as material removal processes which cause the front surface 14 to become rough or otherwise textured.

The fibers comprise a carbon fiber material but may comprise other materials suitable for forming the sheet 12 as described. Carbon fiber materials, however, are notable for their stiffness and high strength-to-weight ratio compared to other materials, such as steel. Various weaves may be used for the sheet 12, including a quasi-isotropic weave which results in the sheet 12 having uniform strength in all directions across the sheet 12 from opposite ends of a perimeter of the sheet 12.

An adhesive 22 is positioned on the back surface 16 of the sheet 12 so that the sheet 12 may be adhered to the paddle. The adhesive 22 covers the entirety of the back surface 16 but may cover smaller portions in other embodiments. Other embodiments may use other connectors to attach the sheet 12 to the paddle, including magnets, hook-and-loop fasteners, ties, and the like.

A liner 24 is releasably coupled to the adhesive 22 opposite the sheet 12 to prevent the sheet 12 from attaching to various surfaces prior to application on the paddle. The liner 24 includes indicia 32 which indicate paths along which the sheet 12 may be cut to size the sheet 12. In this manner, the sheet 12 may be attached to one of a variety of differently sized paddles. The indicia 32 may be printed, embossed, perforated, or otherwise formed.

The indicia 32 includes a plurality of U-shaped cutting paths 34 and a plurality of cross cutting paths 42. The U-shaped cutting paths 34 are arranged concentrically to each other. A pair of ends 36 of each U-shaped cutting path 34 is positioned at a top edge 26 of the liner 24 such that the ends 36 are laterally spaced from each other with respect to the liner 24. A curved portion 38 of each U-shaped cutting path 34 is positioned distally from the top edge 26 of the liner 24. Each cross cutting path 42 of the plurality of cross cutting paths 42 extends between lateral edges 30 of the liner 24 and is bounded by an innermost U-shaped cutting path 40 of the plurality of U-shaped cutting paths 34. The cross cutting paths 42 are spaced from each other between the top edge 26 of the liner 24 and a bottom edge 28 of the liner 24. In other embodiments, the cross cutting paths 42 may extend across one or more of the U-shaped cutting paths 34.

In an exemplary embodiment of the disclosure, the sheet 12 and liner 24 have widths of 9.0 inches as defined between the lateral edges 30 of the liner 24 and lengths of 12.0 inches as defined between the top edge 26 and the bottom edge 28 of the liner 24. The indicia 32 of the liner 24 of this embodiment may facilitate cutting the sheet 12 to widths of 8.0 inches, 7.5 inches, and 7.25 inches and lengths of 11.0 inches, 10.75 inches, and 10.50 inches. However, sizes may vary in other embodiments.

Figure 3:
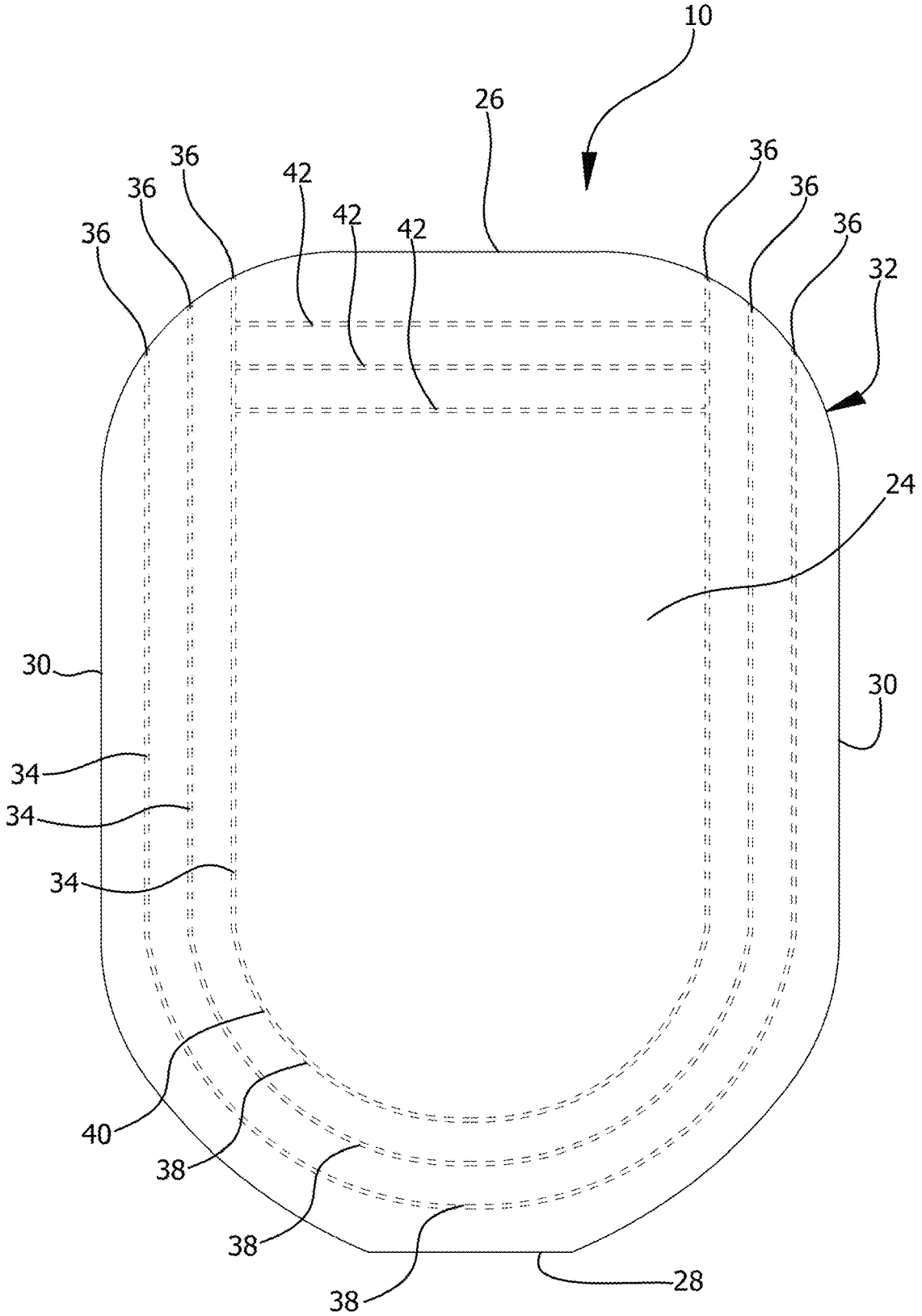
FIG. 3 is a rear view of an embodiment of the disclosure.
Figure 4:
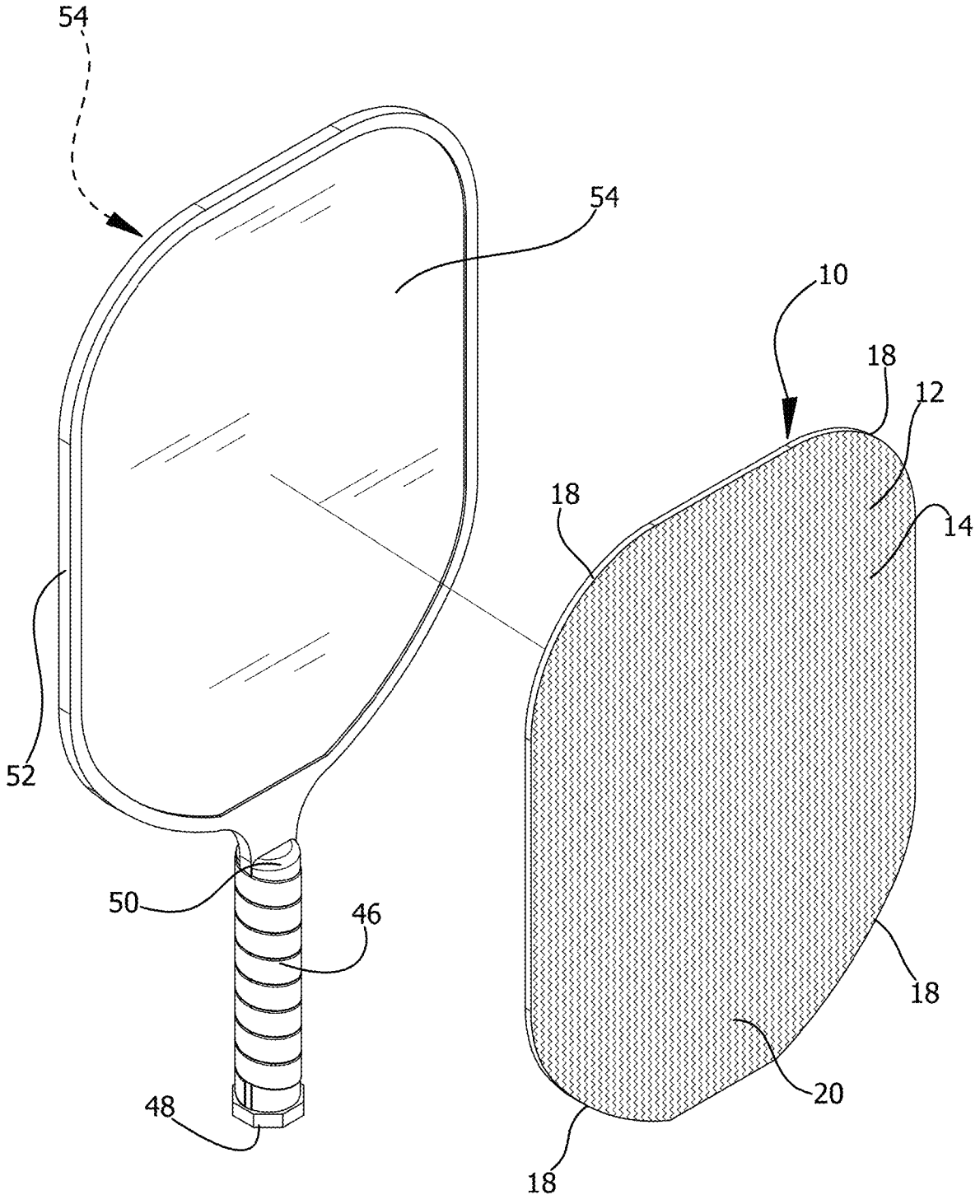
FIG. 4 is a perspective view of an embodiment of the disclosure to be attached to a paddle.
Figure 5:
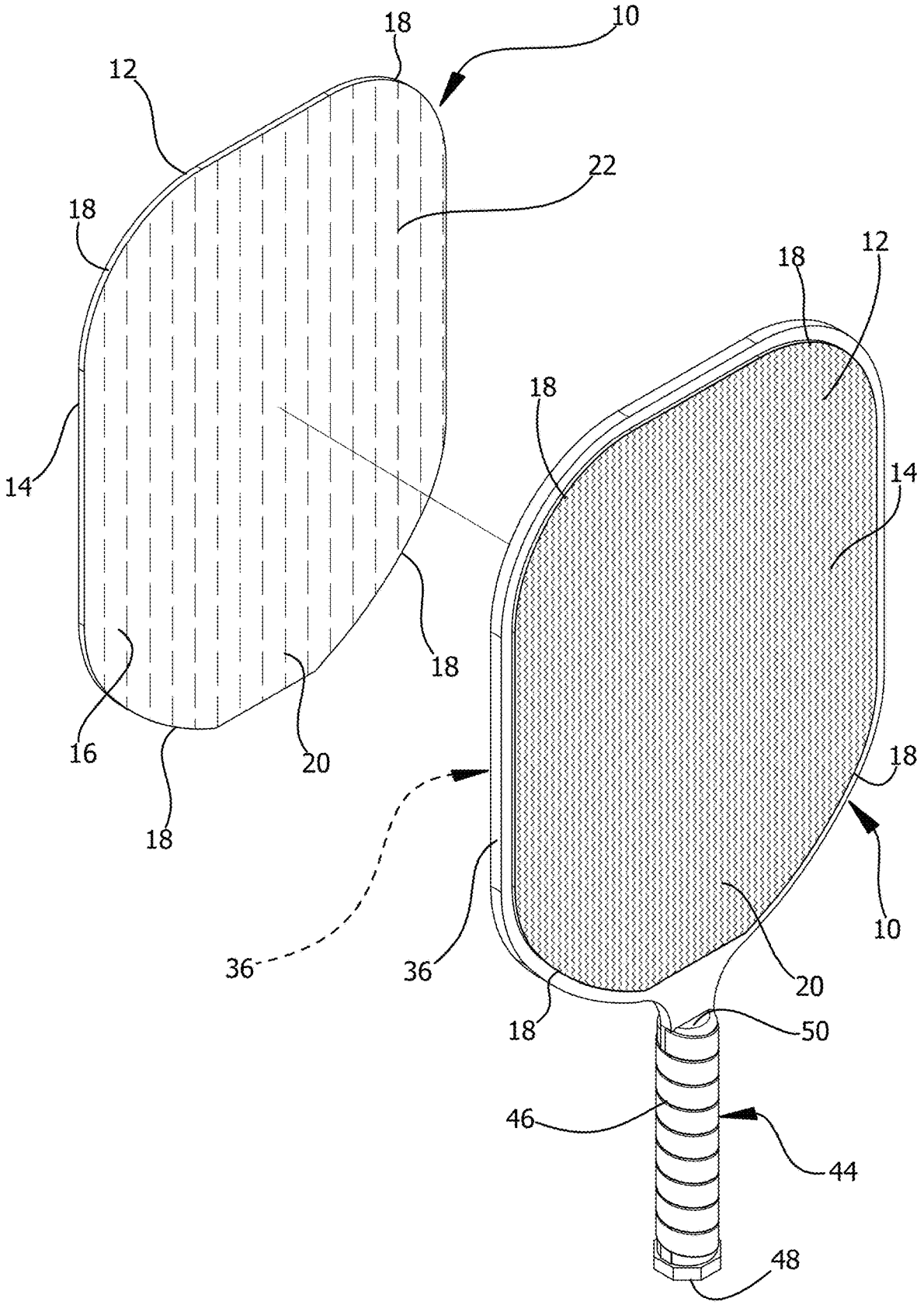
FIG. 5 is a perspective view of a pair of embodiments of the disclosure, one of which is attached to a paddle, the other of which is to be attached to the paddle.
Figure 6:
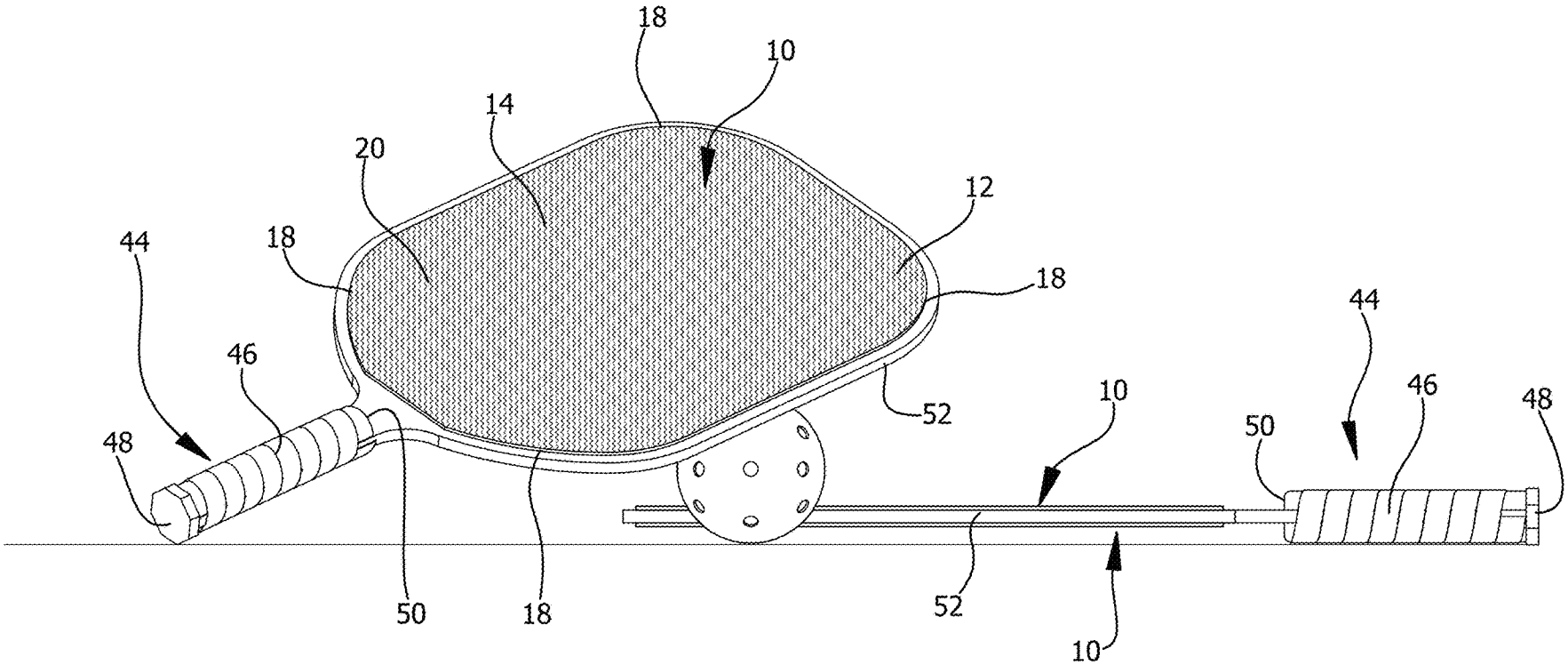
FIG. 6 is an in-use view of embodiments of the disclosure as applied to paddles.

In use, the ball striking apparatus 10 may be attached to a paddle 44 such that the ball striking apparatus 10 may be positioned to strike a projectile when a user urges the paddle 44 toward the projectile. FIGS. 3 and 4 depict such a paddle 44, which comprises a handle 46 and a panel 52. The handle 46 is elongated between a bottom end 48 and a top end 50, and the panel 52 is mounted to the top end 50 of the handle 46. The panel 52 has a generally planar shape and has a pair of striking surfaces 54 facing in opposite directions from each other. The sheets 12 of two ball striking apparatuses 10 attach to respective striking surfaces 54 of the paddle 44 via their adhesives 22. The sheets 12 of the ball striking apparatuses 10 are not cut down in size, but other paddles with striking surfaces 54 of smaller sizes may be used by cutting the sheets 12 as guided by the indicia 32. FIG. 5 depicts two paddles 44 equivalent to the paddle 44 shown in FIGS. 3 and 4 with ball striking apparatuses 10 attached. When the ball striking apparatus 10 wears, it may be replaced by another ball striking apparatus 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ball striking apparatus for use with a paddle, the apparatus comprising:

a sheet having a front surface and a back surface, the sheet being shaped and configured to cover a striking surface of the paddle;

a connector attached to the back surface of the sheet and configured to secure the sheet to the striking surface of the paddle;

a liner on the connector opposite the sheet, the liner being releasably coupled to the connector, the liner having an exposed surface facing away form the connector, the exposed surface having indicia indicating paths along which the sheet may be cut to size the sheet; and wherein the indicia of the liner includes a plurality of U-shaped cutting paths arranged concentrically to each other, a pair of ends of each U-shaped cutting path of the plurality of U-shaped cutting paths being laterally spaced from each other at a top edge of the liner, a curved portion of each U-shaped cutting path being positioned distally from the top edge of the liner; and a plurality of cross cutting paths, each cross cutting path of the plurality of cross cutting paths extending between lateral edges of the liner, the cross cutting paths being spaced from each other between the top edge of the liner and a bottom edge of the liner, each cross cutting path being bounded by an innermost U-shaped cutting path of the plurality of U-shaped cutting paths.

2. The apparatus of claim 1, wherein the front surface of the sheet is frictionally enhanced.

3. The apparatus of claim 1, wherein the sheet comprises fibers which are woven together.

4. The apparatus of claim 3, wherein the fibers of the sheet comprise carbon fiber material.

5. The apparatus of claim 1, wherein the connector comprises an adhesive.

6. A ball striking apparatus for use with a paddle, the apparatus comprising:

a sheet having a front surface and a back surface, the sheet being shaped and configured to cover a striking surface of the paddle, the front surface of the sheet being frictionally enhanced, the sheet comprising fibers which are woven together, the fibers of the sheet comprising carbon fiber material;

an adhesive on the back surface of the sheet, the adhesive being configured to secure the sheet to the striking surface of the paddle; and a liner on the adhesive opposite the sheet, the liner being releasably coupled to the adhesive, the liner having an exposed surface facing away form the adhesive, the exposed surface having indicia indicating paths along which the sheet may be cut to size the sheet, the indicia including:

a plurality of U-shaped cutting paths arranged concentrically to each other, a pair of ends of each U-shaped cutting path of the plurality of U-shaped cutting paths being laterally spaced from each other at a top edge of the liner, a curved portion of each U-shaped cutting path being positioned distally from the top edge of the liner; and a plurality of cross cutting paths, each cross cutting path of the plurality of cross cutting paths extending between lateral edges of the liner, the cross cutting paths being spaced from each other between the top edge of the liner and a bottom edge of the liner, each cross cutting path being bounded by an innermost U-shaped cutting path of the plurality of U-shaped cutting paths.

7. A sports equipment kit comprising:

a paddle comprising a handle and a panel, the panel being coupled to a top end of the handle, the handle being elongated between a bottom end and the top end, the panel having a generally planar shape with a pair of striking surfaces facing in opposite directions from each other;

a pair of ball striking apparatuses couplable to the paddle, each ball striking apparatus of the pair of ball striking apparatuses comprising:

a sheet having a front surface and a back surface, the sheet being shaped to cover either striking surface of the panel of the paddle; and a connector attached to the back surface of the sheet and configured to secure the sheet to either striking surface of the panel of the paddle;

a liner on the connector opposite the sheet, the liner being releasably coupled to the connector, the liner having an exposed surface facing away form the connector, the exposed surface having indicia indicating paths along which the sheet may be cut to size the sheet;

wherein the indicia of the liner of each ball striking apparatus includes a plurality of U-shaped cutting paths arranged concentrically to each other, a pair of ends of each U-shaped cutting path of the plurality of U-shaped cutting paths being laterally spaced from each other at a top edge of the liner, a curved portion of each U-shaped cutting path being positioned distally from the top edge of the liner; and a plurality of cross cutting paths, each cross cutting path of the plurality of cross cutting paths extending between lateral edges of the liner, the cross cutting paths being spaced from each other between the top edge of the liner and a bottom edge of the liner, each cross cutting path being bounded by an innermost U-shaped cutting path of the plurality of U-shaped cutting paths.

8. The kit of claim 7, wherein the front surface of the sheet of each ball striking apparatus is frictionally enhanced.

9. The kit of claim 8, wherein the sheet of each ball striking apparatus comprises fibers which are woven together.

10. The kit of claim 9, wherein the fibers of the sheet of each ball striking apparatus comprise carbon fiber material.

11. The kit of claim 7, wherein the connector of each ball striking apparatus comprises an adhesive.

* * * * *